US009821569B2

(12) United States Patent
Reiniger et al.

(10) Patent No.: US 9,821,569 B2
(45) Date of Patent: Nov. 21, 2017

(54) DEVICE FOR TREATING PACKAGES, AND HOLDING-AND-CENTERING UNIT FOR PACKAGES

(75) Inventors: Markus Reiniger, Monchengladbach (DE); Martin Schach, Bochum (DE); Holger Stenner, Haltern am See (DE)

(73) Assignee: KHS GmbH, Dortmund (DE)

( * ) Notice: Subject to any disclaimer, the term of this patent is extended or adjusted under 35 U.S.C. 154(b) by 757 days.

(21) Appl. No.: 14/342,436

(22) PCT Filed: Jul. 12, 2012

(86) PCT No.: PCT/EP2012/002929

§ 371 (c)(1),
(2), (4) Date: Mar. 3, 2014

(87) PCT Pub. No.: WO2013/029712

PCT Pub. Date: Mar. 7, 2013

(65) Prior Publication Data

US 2014/0208699 A1 Jul. 31, 2014

(30) Foreign Application Priority Data

Sep. 2, 2011 (DE) ..... 10 2011 112 106
Sep. 2, 2011 (DE) ..... 10 2011 112 281

(51) Int. Cl.
*B41J 3/407* (2006.01)
*B41J 3/54* (2006.01)
(Continued)

(52) U.S. Cl.
CPC ..... *B41J 3/4073* (2013.01); *B41J 3/543* (2013.01); *B41J 11/002* (2013.01); *B65B 31/04* (2013.01)

(58) Field of Classification Search
CPC ..... B65B 31/00; B65B 31/04; B65B 61/025; B65B 61/026; B41J 11/002; B41J 3/407; B41J 3/4073; B41J 3/54; B41J 3/543
(Continued)

(56) References Cited

U.S. PATENT DOCUMENTS 1,931,433 A * 10/1933 Davis ..... B67B 1/10 53/296
3,832,892 A * 9/1974 Bohl ..... B67B 3/12 53/341
(Continued)

FOREIGN PATENT DOCUMENTS

DE WO 2010034375 A1 * 4/2010 ..... B41J 11/0015
DE 10 2009 043497 3/2011
DE 102009043497 A1 * 3/2011 ..... B41J 3/4073

OTHER PUBLICATIONS

Archived Wikipedia article titled "Deflection (engineering)", dated Mar. 4, 2011, retrieved from URL https://en.wikipedia.org/w/index.php?title=Deflection_(engineering)&oldid=417004589 on Apr. 19, 2017. Section "End load cantilever beams".*

*Primary Examiner* — Hemant M Desai
*Assistant Examiner* — Valentin Neacsu
(74) *Attorney, Agent, or Firm* — Occhiuti & Rohlicek LLP

(57) ABSTRACT

An apparatus for printing different colors on packages includes holding-and-centering units, each having a primary and a secondary part. The primary part is held at a holding position during package handling. The secondary part is mounted in the primary part to be rotatable about a vertical axis of the unit. The secondary part receives a functional element necessary for handling a package. A plurality of secondary parts adapted to different types, forms and/or sizes of packages are associated with the primary parts.

28 Claims, 16 Drawing Sheets

(51) Int. Cl.
*B41J 11/00* (2006.01)
*B65B 31/04* (2006.01)

(58) Field of Classification Search
USPC ..... 53/411, 403, 432, 79, 510, 131.2, 131.3, 53/367
See application file for complete search history.

(56) References Cited

U.S. PATENT DOCUMENTS 4,827,123 A * 5/1989 Gray ..... G01P 13/045 250/231.14
5,471,054 A * 11/1995 Watanabe ..... G01D 5/24452 250/231.13
5,478,422 A * 12/1995 Bright ..... B65C 3/16 156/351
6,295,737 B2 * 10/2001 Patton ..... 101/35
6,538,767 B1 * 3/2003 Over ..... B41J 3/4073 358/1.18
7,740,349 B2 * 6/2010 Tezuka ..... B41J 3/4073 347/101
8,256,854 B2 * 9/2012 Till ..... B41F 17/18 347/101
2001/0017085 A1 * 8/2001 Kubo ..... B41J 2/01 101/35
2002/0184755 A1 * 12/2002 Suhara ..... H05K 13/0069 29/833
2005/0248618 A1 * 11/2005 Pinard ..... B41J 3/4073 347/54
2006/0144261 A1 * 7/2006 Uptergrove ..... B41J 3/4073 101/35
2006/0250464 A1 * 11/2006 Sheinman ..... B41J 3/4073 347/101
2007/0157559 A1 * 7/2007 Till ..... B41J 2/06 53/411
2007/0251190 A1 * 11/2007 Daigle ..... B29C 65/18 53/403
2009/0145511 A1 * 6/2009 Till ..... B41J 2/06 141/2
2009/0205516 A1 * 8/2009 Till ..... B41F 17/18 101/39
2009/0294069 A1 * 12/2009 Kramer ..... B65C 9/04 156/362
2010/0192517 A1 * 8/2010 Schach ..... B41J 2/0057 53/411
2010/0212773 A1 * 8/2010 Clusserath ..... B67C 3/06 141/6
2010/0257819 A1 * 10/2010 Schach ..... B41J 3/4073 53/411
2010/0307110 A1 * 12/2010 Wilhelm ..... B67B 3/12 53/329.2
2011/0179959 A1 * 7/2011 Gerigk ..... B41J 3/4073 101/40
2011/0206496 A1 * 8/2011 Hecktor ..... B65C 9/067 414/816
2011/0232514 A1 * 9/2011 Putzer ..... B41J 3/4073 101/36
2011/0233838 A1 * 9/2011 Kramer ..... B65C 3/16 269/56
2011/0273726 A1 * 11/2011 Beckhaus ..... B41F 17/18 356/620
2012/0011807 A1 * 1/2012 Preckel ..... B41J 3/4073 53/167

* cited by examiner b a

DEVICE FOR TREATING PACKAGES, AND HOLDING-AND-CENTERING UNIT FOR PACKAGES

RELATED APPLICATIONS

This application is the national stage entry under 35 USC 371 of PCT/EP2012/002929, filed on Jul. 12, 2012, which claims the benefit of the Sep. 2, 2011 priority dates of German applications DE 102011112281.1 and DE 102011112106.8, the contents of which are herein incorporated by reference in their entirety.

FIELD OF INVENTION

The invention is directed to an apparatus for treating packages.

BACKGROUND

Devices for treating packages are known in different embodiments. For example, DE 10 2009 043 497 A1 discloses devices in which the packages are each held on one and the same holding-and-centering unit (puck) during the entire transport from a package inlet to a package outlet, and the holding-and-centering units only release the packages at the package outlet from which the holding-and-centering units are then returned to the package inlet on a puck return transport path.

Printing systems for printing containers with inkjet print heads are known. In particular, printing systems or printing machines are also known in which a plurality of treating or printing positions, each for receiving a container that is to be printed, are formed on a transport element driven to rotate about at least one vertical axis, and on which the containers are printed using electronically triggered digital print heads that operate on the inkjet principle.

SUMMARY

An object of the invention is a device that adapts easily to packages of different type, size, and form with high operational-reliability, or that can be realized with low assembly effort and in a compact design with high operational-reliability.

In one aspect, the device is configured in such a way that the handling positions are each configured on a printing segment having at least one print head. In some embodiments, each printing segment constitutes a fully functional assembly unit.

In some embodiments, the printing segments are arranged, preferably interchangeably, on a rotor or rotor-like machine element that can be driven to rotate about the machine axis.

In some embodiments every printing segment has a solenoid array that forms a stator of the rotary drive for the holding-and-centering units, and/or the at least one incremental sensor for scanning the at least one code of the holding-and-centering units and/or means for holding and/or releasing the holding-and-centering units.

In some embodiments, the printing segments each have a pressure balancing tank for the printing color or printing ink and/or at least one pump for feeding the printing color or printing ink, preferably at least two pumps for feeding the printing color or printing ink and for discharging surplus printing color or printing ink.

In some embodiments, every printing segment has control electronics at least for triggering the print head.

In other embodiments, every handling position or every printing segment has positioning drives for height adjustment and/or for angular adjustment of the print head.

Other embodiments include at least one coupling unit provided on the printing segment or on its housing for an electrical connection as well as for a fluid connection of the printing segment with a coupling unit on the machine or rotor.

Other embodiments include mechanical centering and holding elements on the respective printing segment or on its housing.

Yet other embodiments feature dummy segments that match the printing segments in shape and size but that do not constitute a handling position. Such dummy segments are provided for arrangement between printing segments.

The foregoing features can be combined in an embodiment.

As used herein, "packages" are packaging elements or containers that are usual in the food industry and specifically also in the drinks sector, including, in particular, containers such as, for example bottles, cans, and soft packages, for example those produced from cardboard and/or plastic film and/or metal film.

As used herein, the term "puck," is understood to mean a holding, centering, and, aligning part on which a package element is held and moved from the package inlet to the package outlet through a packaging element transport path of the transport system and that preferably also provides a controlled orientation of the respective package for the latter's handling.

As used herein, "transport elements adjacent to one another for transport purposes" in the sense of the invention means transport elements or transport-and-treatment elements that are configured and arranged in such a way that, at transfer regions, they receive the pucks from an adjacent transport element that is ahead in a transport direction, hold them, and pass them to a transport element that is behind in a transport direction.

As used herein, the expressions "essentially," "in essence," or "around" mean variations from the respective exact value by +/−10%, preferably by +/−5% and/or variations in the form of changes insignificant for the function.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

In particular, a holding-and-centering unit is disclosed and claimed in which the secondary part, in which the packaging element, the bottle or the container is held is mounted on or in a primary part and can be rotated and driven about a vertical axis, and can also be driven by a motor. In one embodiment, the secondary part forms the rotor of an electromagnetic direct drive, and for the controlled aligning and/or rotating of the packaging element to be effected in this way. To achieve this function, the secondary part is provided with a permanent magnet array that interacts with a stator of the electromagnetic direct rotary drive or with a solenoid array that forms the stator.

Alternatively, the secondary part may also comprise an infinitely controllable electric motor, in particular a servomotor. In this case, the primary part comprises the motor housing or consists essentially of the motor housing of an infinitely controllable motor.

Because the rotor or packaging element must be at any time in an angular position, at least one code for the rotational angle position is ideally provided on the secondary part, and, if necessary, also on the primary part. The code interacts with a suitable sensor or reading unit, in particular, one or a plurality of incremental sensors at the respective working position. Moreover, alternatively or additionally, the primary part can always be uniquely defined or definably executed in its rotational angle position relative to the respective handling positions by a form-fitting mounting, centering unit, or a coupling element provided such that only the relative rotational angle position of the secondary part to the primary part need be configured to be detectable by a sensor, reading unit etc. The position relative to the printing segment or print head can then be derived from this.

During the printing of empty packages, especially PET, PEN, PE or PP empty bottles, which represent the normal case, the packaging element should preferably be under a slight positive pressure. For this purpose, there is provided on the holding-and-centering unit a locking or mating piece for a coupling element on the machine or printing segment that is configured in the manner of a quick-acting coupling. With this, a vaporous or gaseous medium, e.g. compressed air, can be fed into the packaging element through an inner line, in this case the hollow interior space of the puck. The lower outlet of this inner line forms a central centering element/taper. For this, at least one transport and handling unit, ideally the first, is connected to a vapor or gas source or comprises a suitable compressor.

The locking element of the coupling is advantageously configured as a non-return valve. Alternatively, a non-return valve is provided in the inner line. In this way, after the preloading to a preload pressure with a vaporous and/or gaseous medium, e.g. compressed air, this preload pressure can be maintained in the packaging element over the entire packaging element transport or pressure section in this way.

BRIEF DESCRIPTION OF THE DRAWINGS

The invention is explained in detail below through the use of embodiment examples with reference to the figures. In the figures.

DETAILED DESCRIPTION

Figure 1:
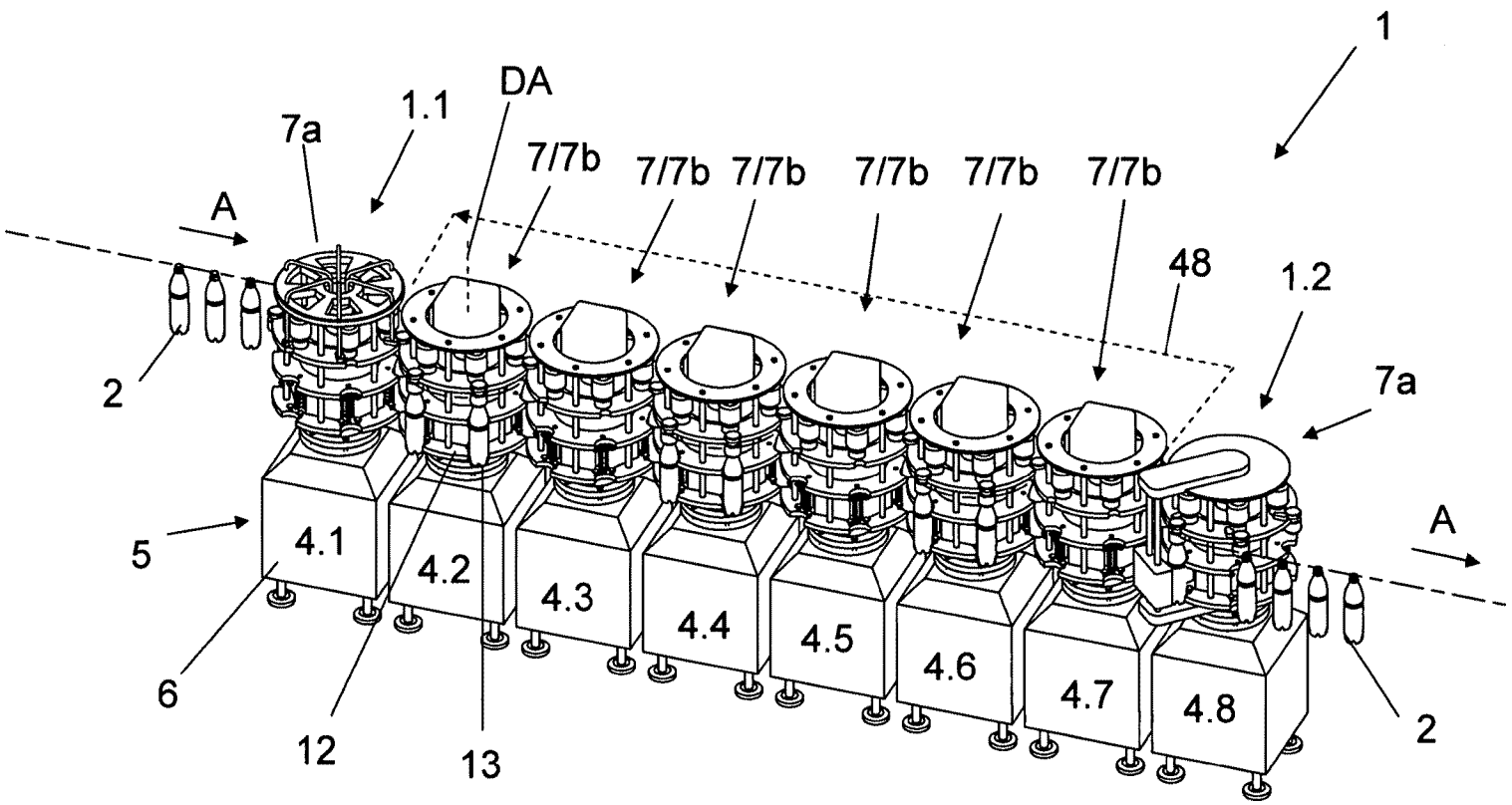
FIG. 1 shows a device that handles packages and that applies, to each package a furnishing in the form of a printed image formed from multiple printing events.

FIG. 1 shows a device 1 that applies a furnishing to packages. The furnishing can be a printed image. In some embodiments, the packages 2 are bottles. The printed image is applied either directly to the exterior of a package 2 or to labels, e.g. provided with partial furnishing, already affixed thereto.

Figures 2, 3:
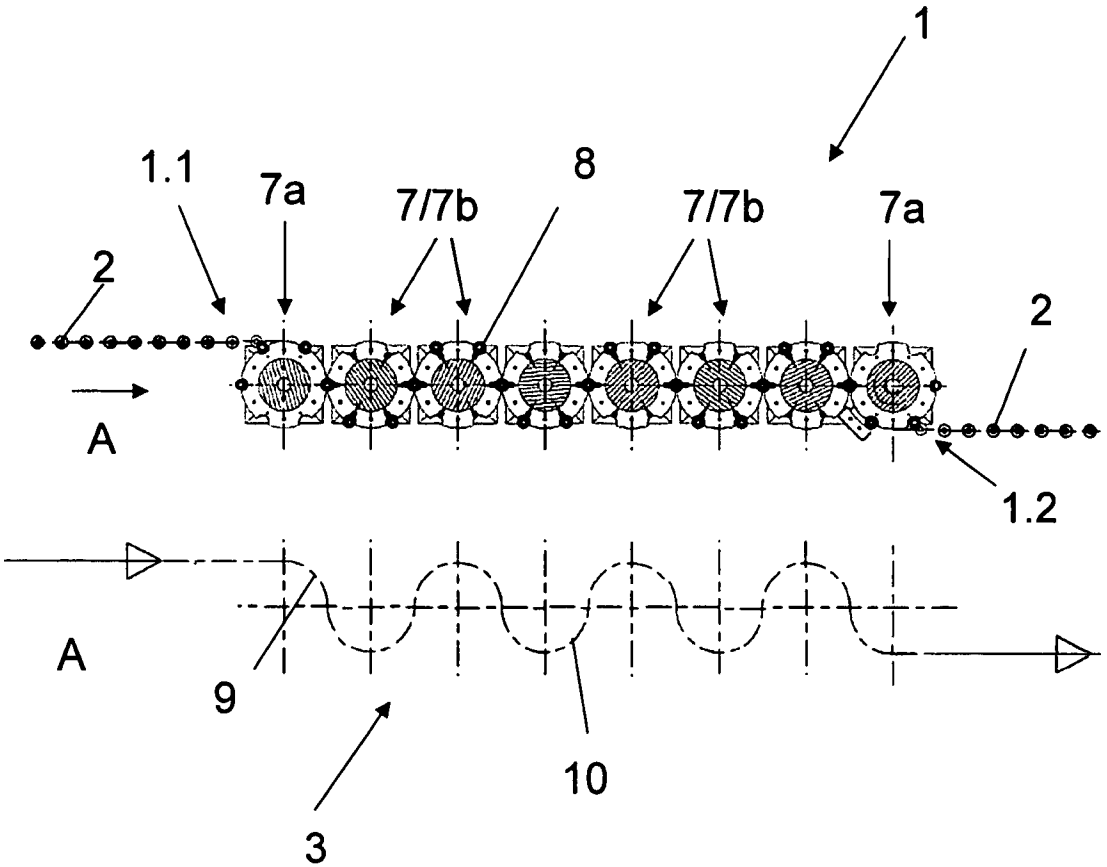
FIG. 2 shows a plan view of the device in FIG. 1.
FIG. 3 a serpentine conveyor path traversed by the packages as they make their way through the device shown in FIGS. 1 and 2.

Packages 2 that are to be printed upon are fed standing upright to the device 1 or to its package inlet by an external transporter in a transport direction A. The packages 2 move within the device 1 on a multiply arcuate deviated conveyor section. After printing, the packages 2 are fed, still standing upright, by an outer transporter to a subsequent use at a package outlet 1.2. FIG. 2 shows a transport path 3 of the packages 2 as they move through the device 1.

The device 1 has a plurality of modules **4.1-4.*n* that are arranged one after the other in transport direction A. In the depicted embodiment, there are eight modules 4.1-4.8, all of which are formed of an identical base unit 5 that is equipped with the functional elements necessary for the special task of each module 4.1-4.8**.

Each base unit 5 comprises a drive-and-control unit accommodated in a module housing 6. Each base unit 5 also comprises a transport-and-treatment element 7, **7*a* that is arranged on the top of the module housing 6. The transport-and-treatment element 7, 7*a* can be driven by its corresponding base unit's drive-and-control unit to rotate about a vertical machine axis of its module 4.1-4.8. A plurality of holders 8 are distributed at equal angular distances around the periphery of the transport-and-treatment element 7, 7*a*. Each holder 8 is configured to reliably pick up one package 2**.

Transport-and-treatment elements 7, **7*a* of individual modules 4.1-8.1 are adjacent to one another. The transport-and-treatment elements 7, 7*a* are driven in counter-rotation but synchronously such that they collectively form a transport device that moves packages 2 within the device 1 along a serpentine packaging-element transport path 3 shown in FIG. 3 between a package inlet 1.1 and a package outlet 1.2. Individual packages 2 are each transferred directly from a transport-and-treatment element 7 of one module 4.1-4.7 to a transport-and-treatment element 7 of the module 4.2-4.8** that follows in a transport direction A.

In FIGS. 1 and 2, the transport-and-treatment element 7 of module 4.1, which is the first one along the transport direction A, is driven synchronously clockwise; the transport-and-treatment element 7 of the succeeding module 4.2 is driven counter clockwise; the transport-and-treatment element of the next-following module 4.3 is driven clockwise; and so forth. A suitable controller synchronizes the individual modules 4.1-4.8.

In the embodiment shown in the figures, individual modules 4.1-4.8 are again provided sequentially such that the vertical machine-axes of all modules 4.1-4.8 lie in a common vertical plane. Also located in this plane are the transfer regions where packages 2 are transferred from a transport-and-treatment element 7*a*, 7 of one module 4.1-4.7 to a transport-and-treatment element 7, 7*a* of another module 4.2-4.8 that follows in the transport direction A.

The first module 4.1 constitutes the inlet module or package inlet 1.1 of the device 1. Preferably, the first module 4.1 pretreats packages 2, at least in the region of the packaging element that is to be printed upon. Examples of pretreatment include plasma or corona treatment. This treatment is practical if the application of the multiple-pass print in the subsequent modules is effected with the use of print stations or print heads in those modules and which operate according to the known inkjet print head principle or Tonejet principle. It is also advantageous to pressurize the package 2 in the first module 4.1.

Second through fifth modules 4.2-4.5 following module 4.1 constitute the actual print modules in which the multiple-pass print is effected, preferentially as color printing in which one color is printed at each of the modules 4.2-4.5, for example in yellow, magenta, cyan and black. Holders 8 that are located there therefore constitute handling or printing positions.

A sixth module 4.6, which then follows in transport direction A, is configured as a drying module in which the previously generated multiple-pass print is finally dried in a suitable manner. Embodiments include those that dry by applying energy, such as heat energy and/or by UV radiation.

The seventh module 4.7 is an inspection module through which each package 2 passes after the drying of the multiple-pass print and in which the multiple-pass print concerned is examined for possible errors such that incorrectly printed packages 2 can be separated out at the module 4.7 or subsequently on the onward transport path.

Finally, the eighth module 4.8 constitutes an outlet module or package outlet 1.1 of the device 1. It is through here that the fully printed packages 2 leave the device 1. The eighth module 4.8 is preferentially also configured as a drying module.

As FIG. 3 shows, packages 2 are each moved with transport-and-treatment elements 7 of the first and eighth modules 4.1, 4.8 over an angular range of approximately 90° about a vertical machine axis MA of the first and eighth modules 4.1, 4.8. In the case of the second through seventh modules 4.2-4.7, packages 2 are each entrained by respective transport-and-treatment element 7 over an angular range of 180° about the vertical machine axis of modules 4.2-4.7. The process that is assigned to the respective module is carried out in modules 4.2-4.7, within this angular range or within this path of the rotational motion of respective transport-and-treatment element 7.

In greater detail, modules 4.1-4.*n*, but at least modules 4.2-4.7, which are used for the printing of packages 2, or circulating transport-and-treatment element 7 of these modules, include printing segments 11 that are each mounted interchangeably as complete functional assembly units on a rotor 12 that is driven to rotate about respective vertical machine axis MA. The rotor 12 is mounted so as to rotate about the vertical machine axis MA on the module housing 6 or on a central pillar 13.

Figure 12:
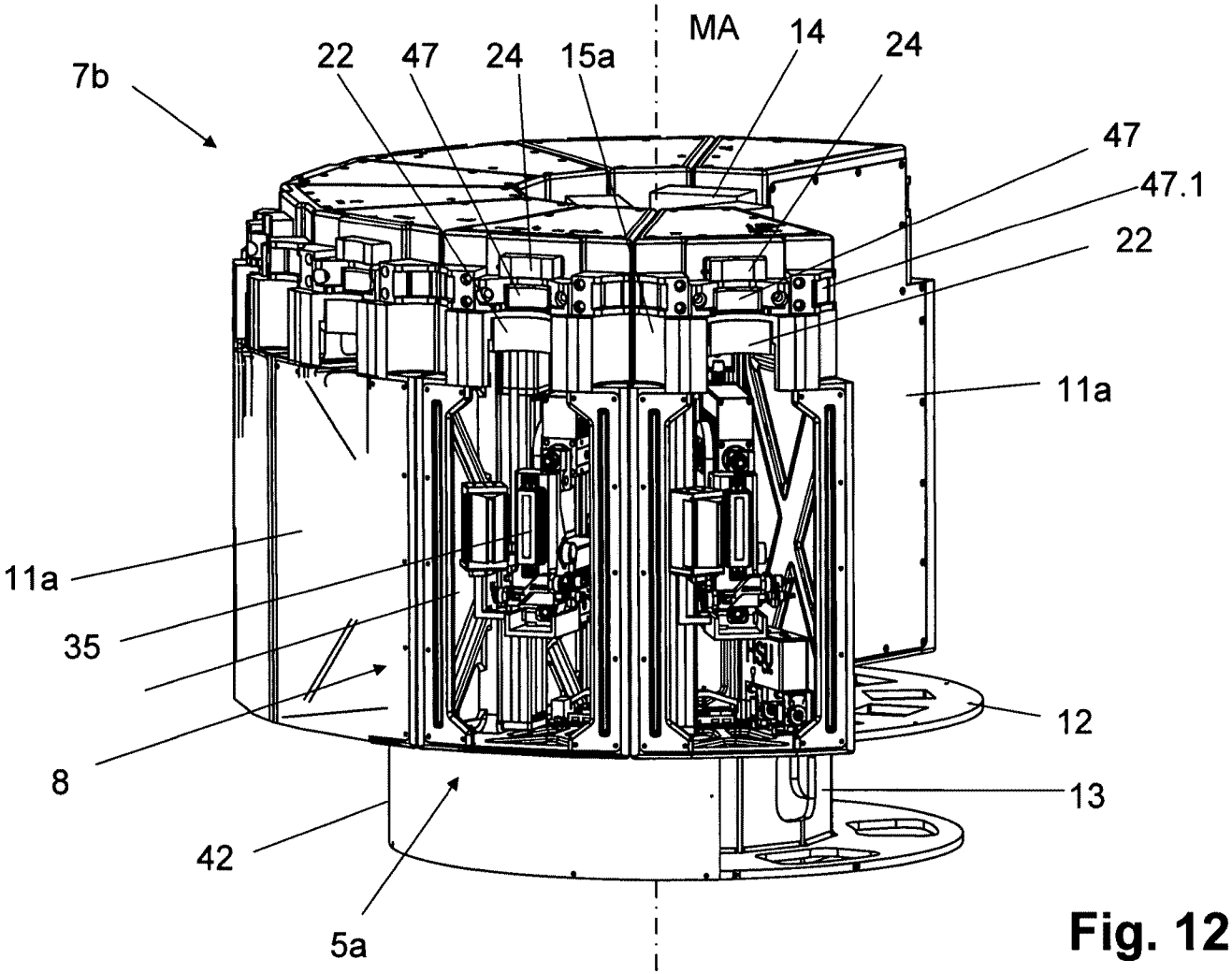
FIG. 12 shows, in perspective representation, a transport-and-treatment element of a further embodiment of the invention, preferably for use with the device or installation of FIG. 1.

The printing segments 11 are disposed adjacent to one another along the periphery of the rotor 12. In plan view, these printing segments 11 are configured like wedges. The printing segments 11 enclose a space in the region of the machine axis MA. As shown in FIG. 12, this space accommodates functional elements for triggering printing segments 11. Such functional elements include electronic control elements or computers 14.

Figure 4:
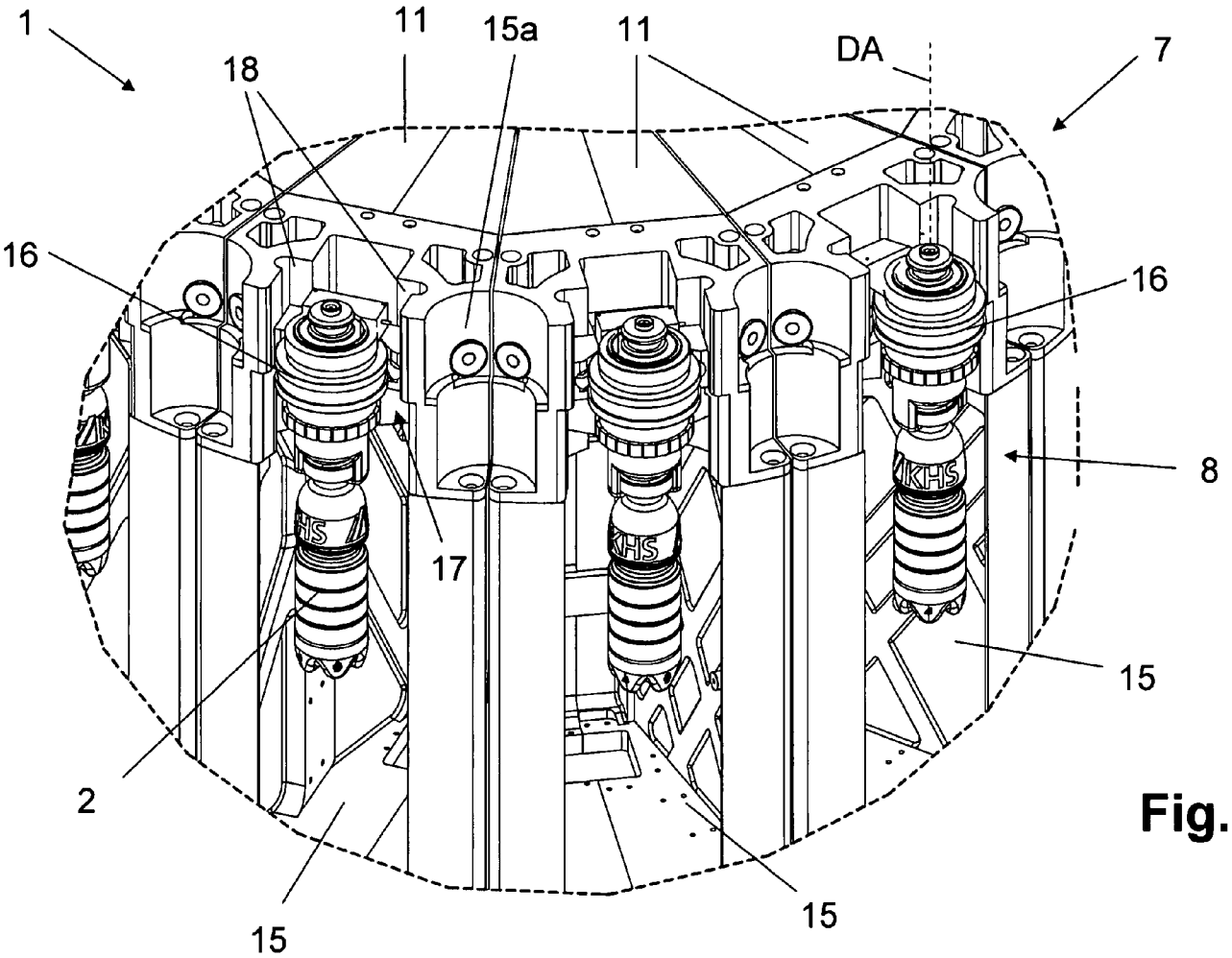
FIG. 4 shows a perspective partial view one of the transport-and-treatment elements, which showing a plurality of printing segments.
Figure 5:
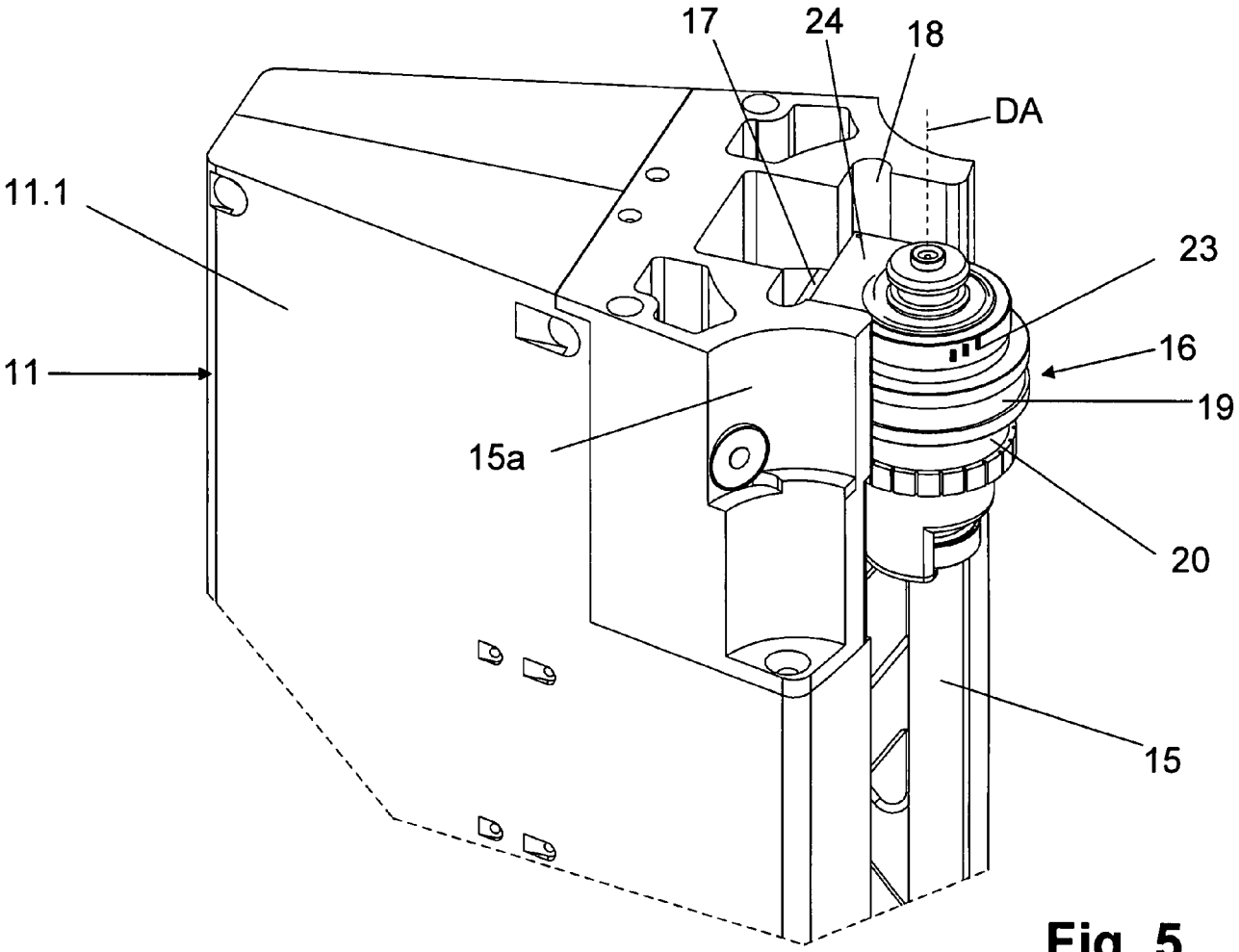
FIG. 5 shows a printing segment of the transport-and-treatment element of FIG. 4.
Figure 7:
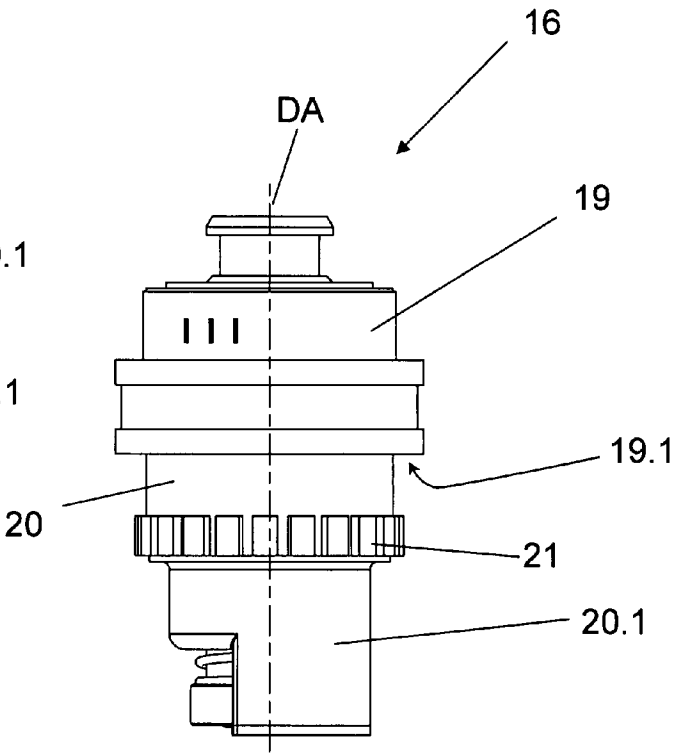
FIGS. 6-8 show, in different representations, a holding-and-centering unit of the device of FIG. 1, also together with a packaging element configured as a bottle.
Figure 6:
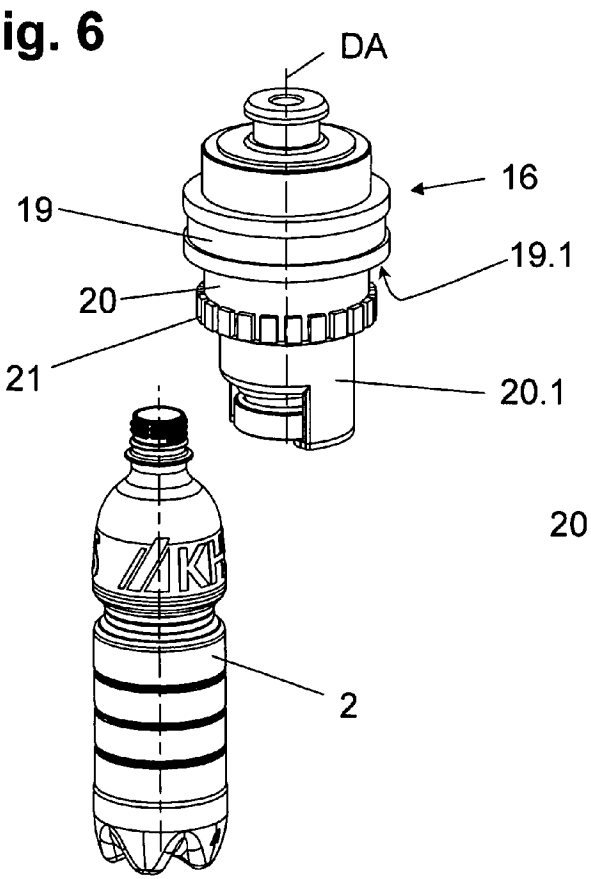

Each printing segment 11 has a side that is radially outward relative to the machine axis MA. As shown in FIGS. 4 and 5, this radially-outward side forms a recess 15. During handling, each recess 15 receives a package 2 at least by a part of its package body. At the time the recess ∫ receives the package 2, a holding-and-centering unit 16 suspends the package 2 from a region around the package's top or opening. As a result, the package 2 is oriented vertically and parallel to machine axis MA and to a printing-segment axis DA. In the region at which the package 2 is mounted, and in particular, in the region of the recess 15, each printing segment 11 includes both at least one print head and any other functional elements required to print on the package 2.

Figure 13:
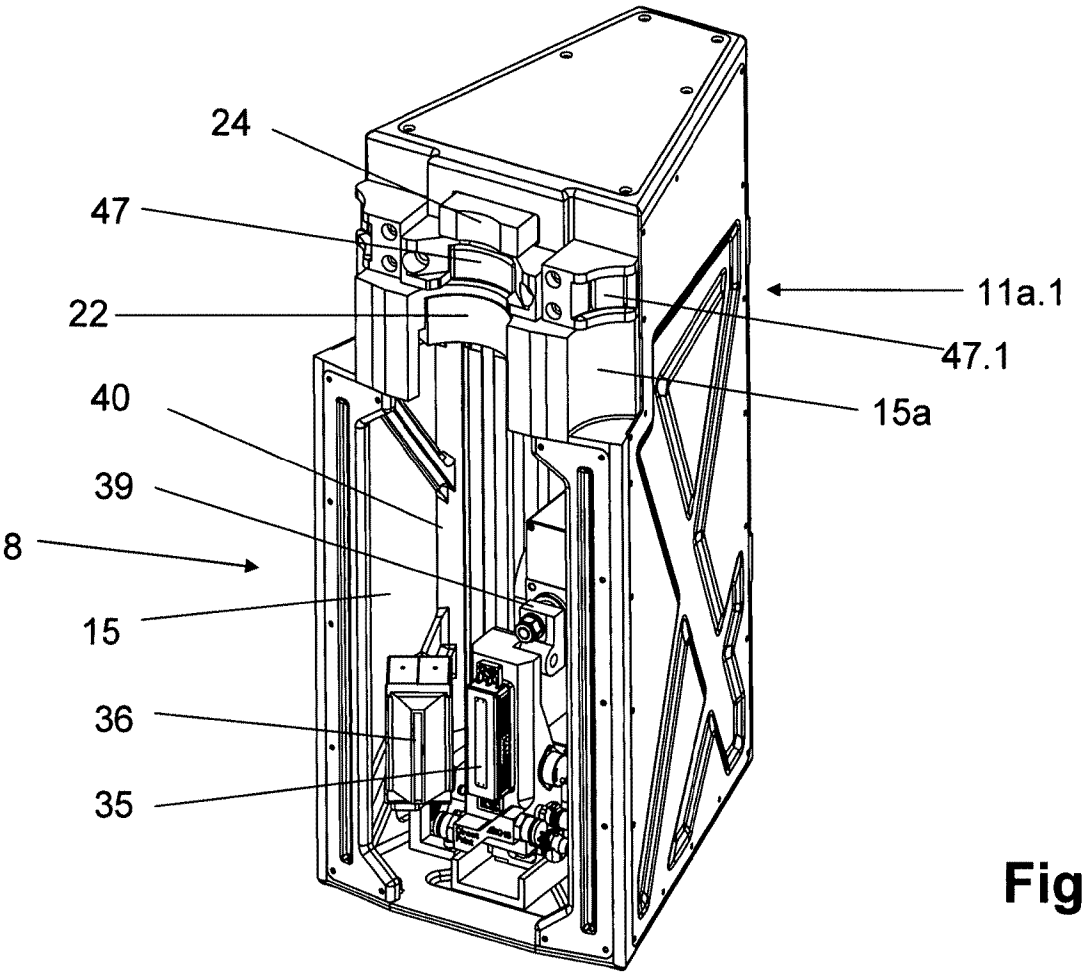
FIGS. 13 and 14 show different views of a printing segment of the transport-and-treatment element of FIG. 12.
Figure 14:
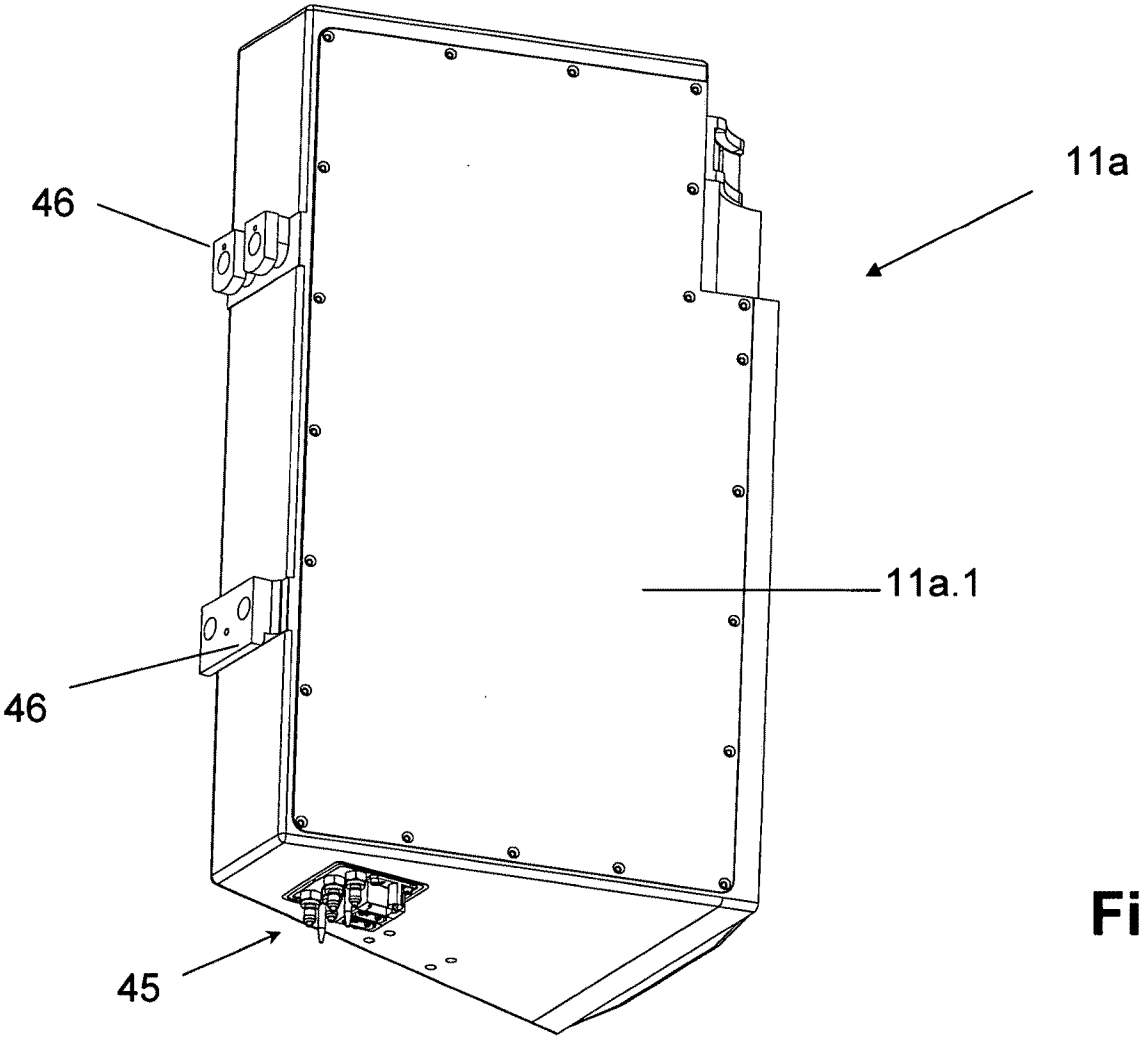
Figure 15:
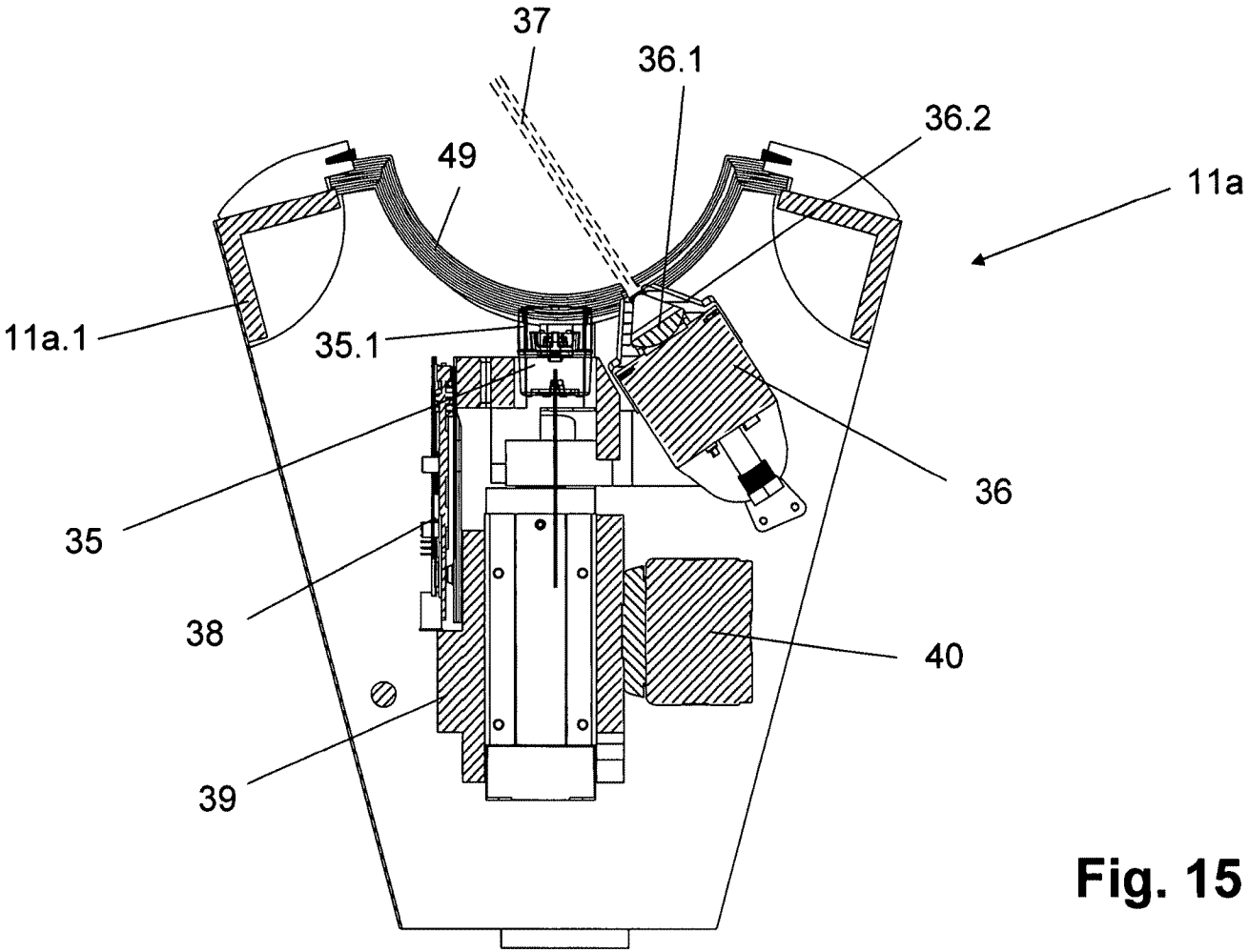
FIG. 15 shows a simplified horizontal section through the printing segment of FIGS. 13 and 14.
Figure 16:
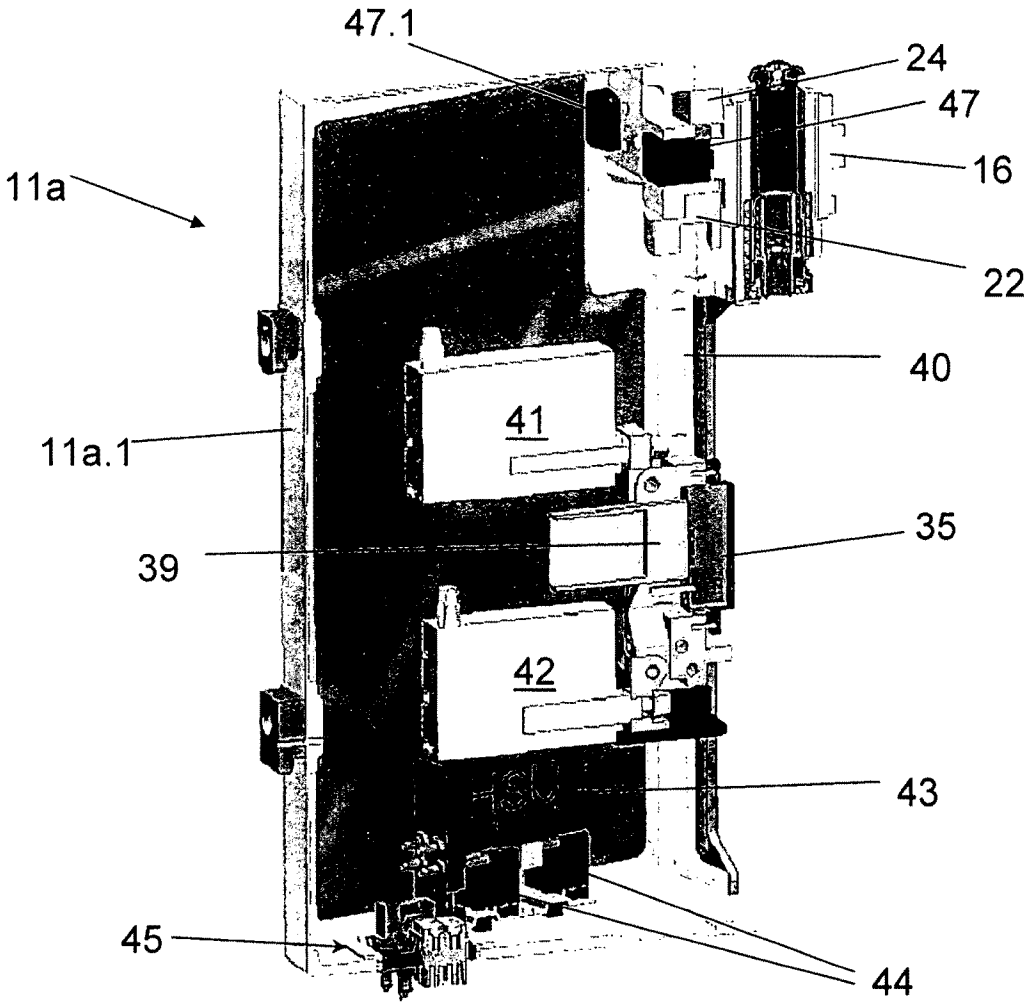
FIG. 16 shows a simplified vertical section through the printing segment of FIGS. 13 and 14.

Referring to FIG. 5, each holding-and-centering unit 16 is held on a carrier 17. The carrier 17 is fastened in associated lateral slots 18. In some embodiments, the carrier 17 can be traversed or displaced along its associated lateral slots 18 like a carriage or driven by a motor if applicable. In an alternative embodiment, depicted in FIG. 13, the carrier 17 is not configured in that form. In this embodiment, all elements or functions are directly integrated into the printing segment 11, 11*a*.

During package handling and/or printing, a holding-and-centering unit 16 causes either alignment, controlled rotation, and/or pivoting of the package 2 about its vertical packaging-element axis. This packaging-element axis is disposed along the same axis as the printing-segment axis DA.

Each holding-and-centering unit 16 includes a primary part 19 and a secondary part 20. The holding-and-centering unit's corresponding carrier 17 holds the primary part 19. The secondary part 20 is below the primary part 19.

The primary part 19 secures and aligns the holding-and-centering unit 16 on its carrier 17, on a holder 8, or on a printing segment 11. For this purpose, the primary part 19 includes a reference face 19.1 whose complementary counterpart in the printing segment 11 serves as a reference plane or reference face for locating and hence for adjustment relative to the print head. This creates a fixed common reference between the holding-and-centering unit 16 or packages 2 and its corresponding print head or print heads.

The secondary part 20 includes a gripper that suspends the package 2. Embodiments include a mechanical gripper, a pneumatically-actuated gripper, and/or a vacuum gripper. Preferably, while in the printing segment 11, the required holding force is passively applied to the primary part 19 and actively removed or released, for example by way of one or a plurality of permanent magnets, so as to increase safety in the absence of flow or media.

The secondary part 20 includes the active components. These active components include mechanical elements and pneumatic elements. The mechanical elements are needed for aligning, controlled rotating and/or pivoting of the package 2 during handling. The pneumatic elements supply compressed air and/or provide exposure to a vacuum.

The secondary part 20 is mounted on the primary part 19 so as to be able to rotate or pivot about the printing-segment axis DA. In the illustrated embodiment, the secondary part 20 includes the rotor of an electric positioning or angular drive for the aligning and controlled rotating or pivoting of a package 2 during handling.

The secondary part 20 also includes a permanent-magnet array 21 that has a plurality of permanent magnets. In a peripheral direction, the permanent-magnet array 21 has alternating north and south poles. The permanent-magnet array 21 interacts with a solenoid array 22 that is provided on the carrier 17. The solenoid array 22 forms the stator of a positioning drive or electromagnetic direct drive.

As shown in FIG. 5, the primary part 19 includes a code 23 that interacts with an incremental sensor 24 provided on the carrier 17. The incremental sensor 24 uses the code 23 to determine the random orientation of the primary part 19, and hence an orientation of the holding-and-centering unit 16. After having been determined by the encoder system, this orientation can then be taken into account when aligning and carrying out controlled rotating of the packages 2 during printing. Package-handling occurs solely by rotating the secondary part 20. The primary part 19 need not rotate. The incremental sensor 24 rotates with the rotor 12 or pillar 13. The alignment and controlled rotation of the package 2 about the printing-segment axis DA is effected relative to the printing segment 11 or relative to functional elements located at the printing segment 11, such as print heads.

Figure 9:
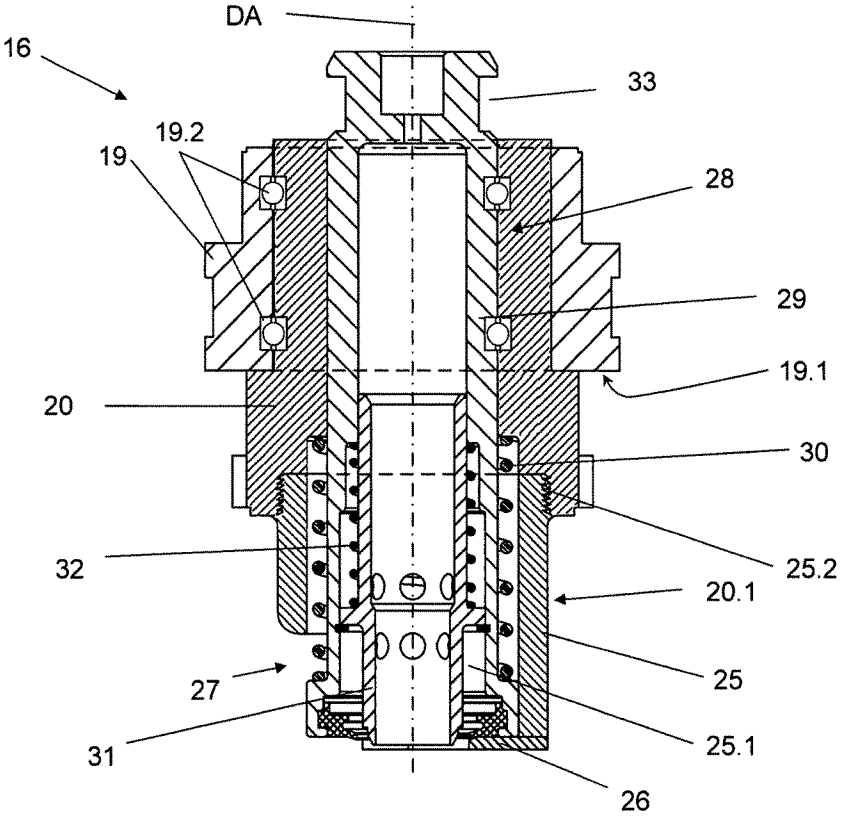
FIG. 9 shows a section through a holding-and-centering unit of the device of FIG. 8.

FIG. 9 shows a sectional view of the holding-and-centering unit 16 in an idle position. In this idle position, the holding-and-centering unit 16 does not carry a package 2.

The holding-and-centering unit 16 has a ring-like primary part 19 and a sleeve-like secondary part 20 that is mounted in the primary part 19 so as to be able to rotate about the printing-segment axis DA. A lower length of the secondary part 20 projects beyond the underside of the primary part 19. This lower length of the secondary part 20 is configured with a mounting-and-base part 20.1.

FIG. 9 shows bearings 19.2 that permit the secondary part 20 to rotate relative to the primary part 19. These can include a bearing sleeve, needle bearing, or an equivalent structure.

The mounting-and-base part 20.1 is adapted to the type, shape, and size of the packages 2. It forms part of a gripper for holding an empty package 2.

Specifically, the mounting-and-base part 20.1 has a sleeve 25 and a carrier plate 26. The sleeve 25 is arranged with its axis on the same axis as the printing-segment axis DA. The carrier plate 26 is at the lower open end of the sleeve 25.

A thread 25.2 permits the mounting-and-base part 20.1 to be separated from the upper section of the sleeve 25. Instead of a thread 25.2, it is possible to use a bayonet closure, clamp or other mechanism.

A lateral opening 27 in the sleeve 25 permits a package to be introduced into the mounting-and-base part 20.1. This procedure is shown in FIG. 10 for the case of a package 2 embodied as a bottle.

Figure 10:
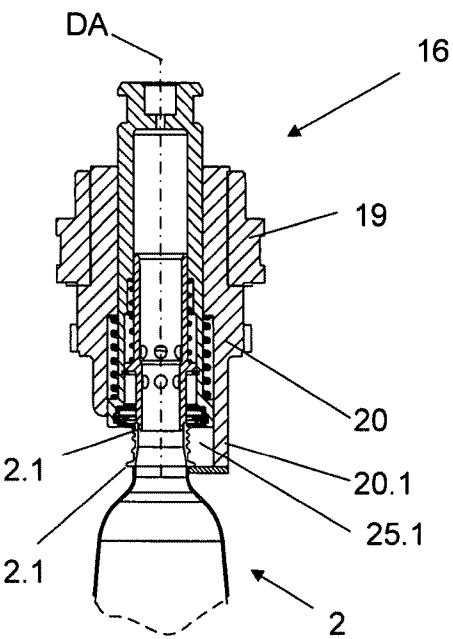
FIG. 10 shows, in positions a) and b,) the holding-and-centering unit and a bottle at different times during operation.
Figure 10:
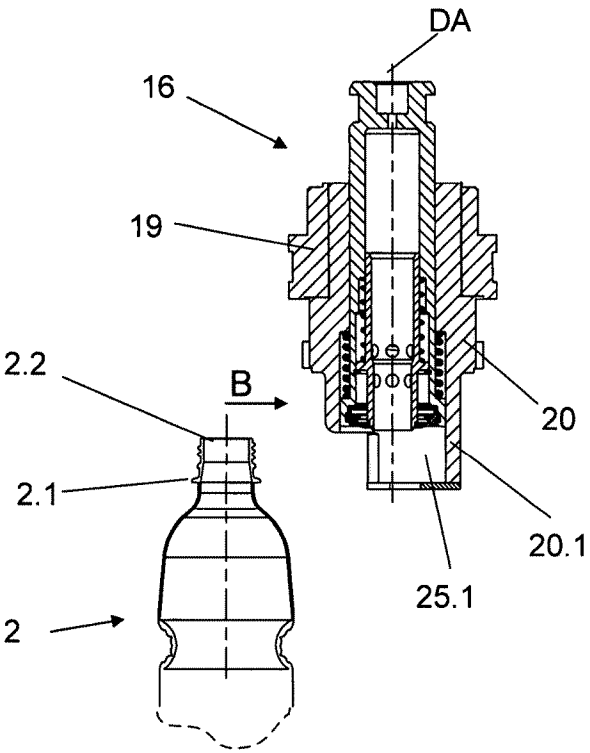

Position (a) of FIG. 10 shows a package 2 being moved along an introducing direction B towards the lateral opening 27 formed in the mounting-and-base part 20.1. Position b of FIG. 10 shows the package 2 fixed to the mounting-and-base part 20.1 in such a way that the carrier plate 26 suspends the package 2 by its mouth edge 2.1.

Referring back to FIG. 9, within the secondary part 20, a centering-and-holding element 28 is arranged to be axially displaceable relative to the printing-segment axis DA. The centering-and-holding element 28 includes an outer sleeve-body 29. A first compression spring 30 preloads the outer sleeve-body 29 into a lower position.

The sleeve body 29 lies with its lower end face against the carrier plate 26. When the package 2 is a bottle held at a holding-and-centering unit 16, the sleeve body 29 lies against the upper side of the package 2, which faces away from the carrier plate 26 or against the mouth edge 2.2 of the package 2 located there. The force of the first compression spring 30 between the sleeve body 29 and the carrier plate 26 firmly clamps the package 2 so that it cannot rotate.

The centering-and-holding element 28 also includes centering sleeve 31 arranged on the same axis as the printing-segment axis DA. This centering sleeve 31 is axially displaceable. A second compression spring 32 preloads the centering sleeve 31 into a lower position. As can be seen in FIG. 9, the first and second compression springs 31, 32 are concentric.

In order to receive a package 2, a lifting element engages behind a collar or annular slot 33 of the sleeve body 29. Such a lifting element is provided at the package inlet 1.1 and the package outlet 1.2. The lifting element raises the centering-and-holding element 28 against the action of the first compression spring 30.

After the package 2 has been introduced into the holding-and-centering unit 16, the first and second compression springs 30, 32 urge the centering-and-holding element 28 downward, thereby centering and positioning the package 2 in the mounting-and-base part 20.1 and passively clamping it.

In the process, the centering sleeve 31 centers the package 2 in such a way that the package axis is coaxial with the printing-segment axis DA. The packages 2, which can be bottles, can then be printed upon while they are empty.

The concentrically arranged first and second compression springs 30, 32 and the guides and supports that can be pushed into one another are coupled to apply a weaker force during centering and a stronger force during clamping. Thus, when the package 2 is being centered, a weak spring force acts on the container mouth so that a slight movement of the package 2 on the carrier plate 26 can still take place. Once the package 2 is centered, a final holding force achieves a gas-tight condition, as shown in FIG. 11.

Figure 11:
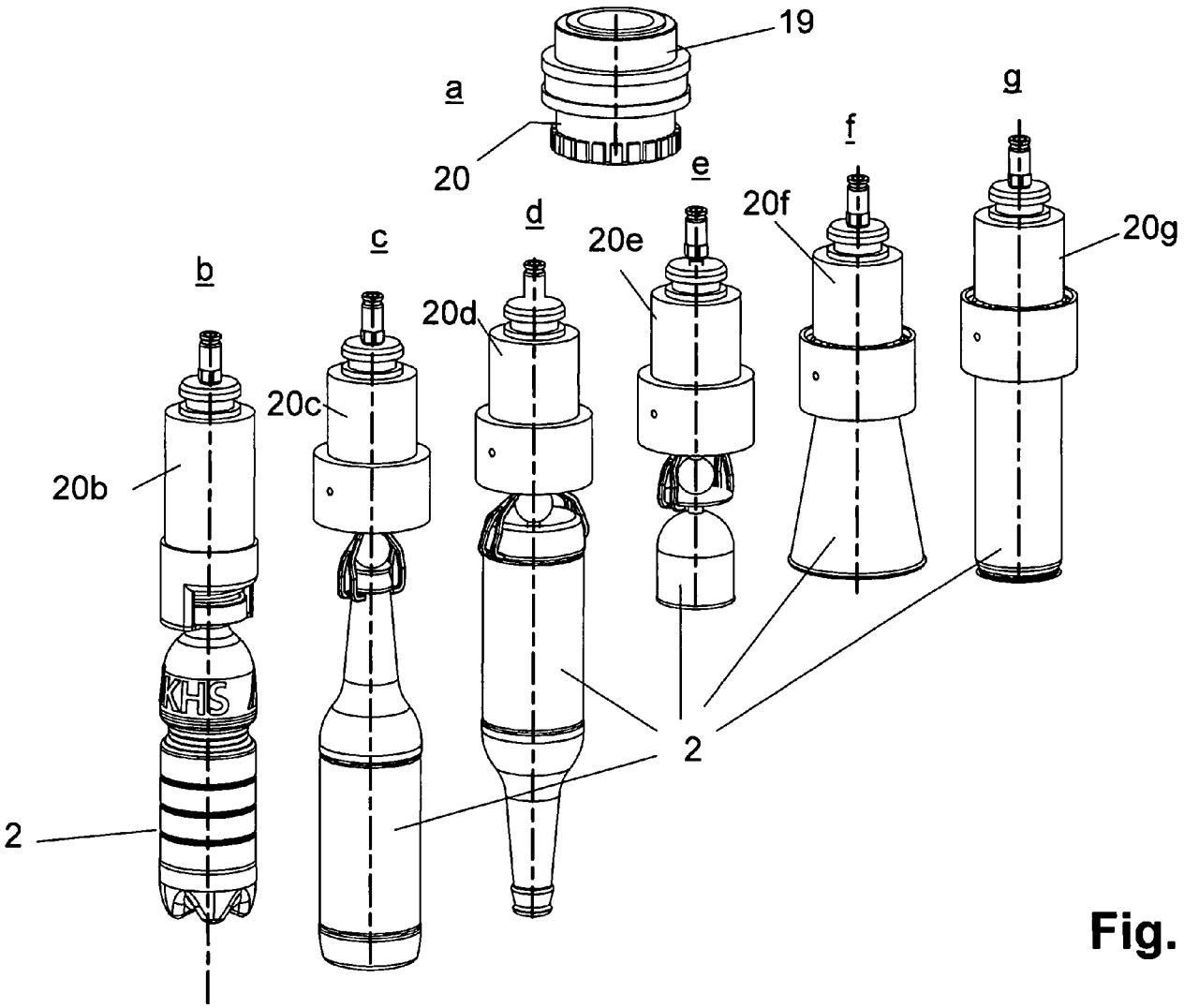
FIG. 11 shows, in position (a), in perspective representation, a primary part of a holding-and-centering unit and in positions (b)-(g) different secondary units that can be combined with the premier part of a holding-and-centering unit.

FIGS. 10 and 11 in turn show an alternative embodiment in which the mounting-and-base part 20.1 is not detachable or is made of a single piece.

The illustrated embodiment shows the use of springs to achieve the required forces. However, other equivalent drives are conceivable for the clamping of the packages. These equivalent drives include, for example, pneumatically or electrically driven gripping and/or clamping elements.

Packages 2 are picked up in a protected manner by their mouth region between mouth flange 2.1 and mouth edge 2.2 in the interior 25.1 of the sleeve 25. In particular, with a very hygienic variant, it is an advantage to configure holding-and-centering units 16 or their secondary parts 20 in such a way that the mouth 2.2 of a package 2, and nearby structures such as the mouth region and a thread located in the mouth regions, are all protected from dirt and ink spray during the printing operation.

In order to stabilize the still-empty packages 2, it is expedient to fill them with a pressure medium, such as a pressurized gaseous and/or vaporous medium, for example with compressed air. This filling occurs during or after a packages 2 has been fixed to its holding-and-centering units 16.

Figure 8:
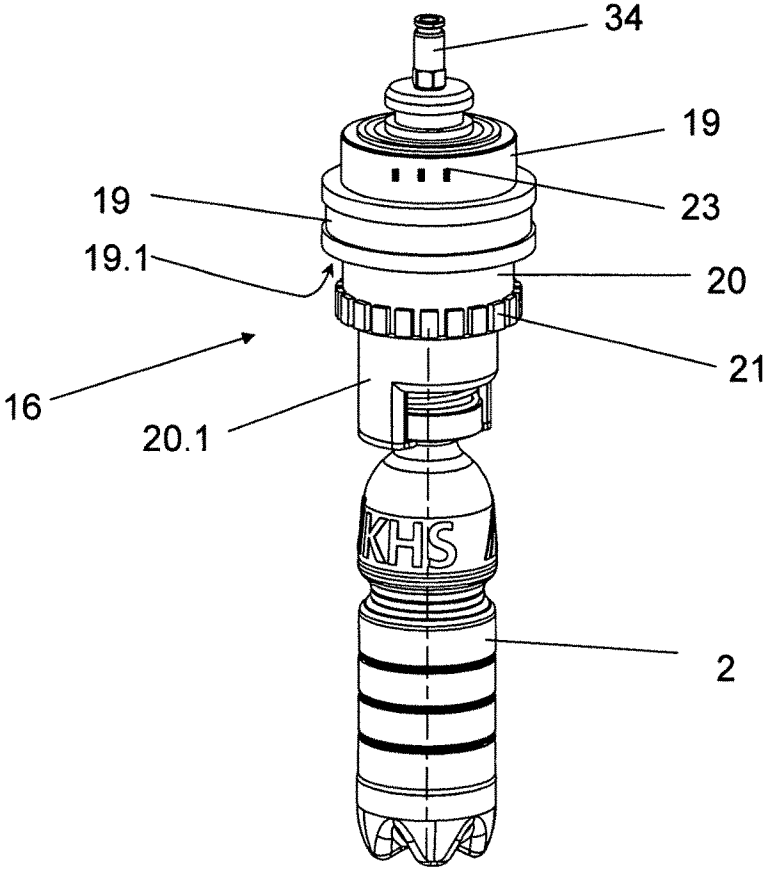

As shown in FIG. 8, a quick-acting coupling 34 connects to a source of pressurized medium at the holding-and-centering unit 16 or at its centering-and-holding element 28. The internal pressure in the package 2 can continue to be controlled by this quick-acting coupling 34, by a line (also not shown) in the interior of the holding-and-centering unit 16 and by a gas outlet. Ideally the internal pressure is held constant over the entire transport path. As can be seen from FIG. 9, the holding-and-centering unit 16 has a central inner cavity through which the pressurized medium can pass into package's interior.

Packages come in different package formats. A format refers to the type, size, and/or shape of a package. A container-processing machine is expected to be able to process packages with different formats.

The secondary part 20 is preferentially configured in such a way that a format-dependent mounting-and-base part 20.1 can be attached to and detached from the secondary part 20. This makes it easier to reconfigure the secondary part 20 for processing packages 2 having different package formats.

When reconfiguring the machine to accommodate a new package format, it becomes possible to simply exchange the mounting-and-base parts 20.1 on the holding-and-centering units 16 with a suitably matching format-dependent mounting-and-base part 20.1. The format-dependent mounting-and-base part 20.1 is preferably mounted to the secondary part 20 in a torsion-proof manner, for example with the help of a quick-change mechanism, a quick-acting coupling, a screw fastener, and/or a clamp-fastener.

FIG. 11 again shows, in position (a), a primary part 19 of a holding-and-centering unit 16 in single view, and in positions (b)-(g), first through sixth different secondary parts 20*b*-20*g* for different packages 2. These secondary parts are formed at least in part by different mounting-and-base parts 20.1. In the case of the depicted embodiments, the first, second, third, and fourth secondary parts 20*b*-20*e* are mechanical grippers that are actuated by, for example by compressed air. The fifth and sixth secondary parts 20*f*, 20*g* are vacuum grippers.

The first, second, and fourth secondary parts 2*b*, 2*c*, 2*e* hold their respective packages either at the top of the package or in the region of the package's opening. The fourth secondary part 2*d*, in contrast, holds the package by its underside. The fifth and sixth secondary parts 20*f*, 20*g* both hold a package from its top.

Some embodiments include a unique identifier for each holding-and-centering units 16, and preferably each secondary part 20. A suitable identifier is an RFID code that identifies the holding-and-centering unit 16. The RFID code can include information about the unit's type and/or information about its particular secondary part 20. The corresponding information can then be read out by at least one reading unit of the device 1 and/or of respective print module 4.1-4.*n*, for example for monitoring or inspection purposes.

FIG. 12 depicts a transport-and-treatment element 7*b* that can be used in the device 1 instead of transport-and-treatment elements 7. The transport-and-treatment element 7*b* differs from transport-and-treatment elements 7 essentially in that the printing segments 11*a* that form transport-and-treatment elements 7*b* do not have the height-adjustable or displaceable carrier 17. Instead, each holding-and-centering unit 16 is held directly, i.e. not height-adjustably, on its printing segment 11*a*.

Accordingly, incremental sensor 24 and solenoid array 22 are also provided on the printing segment 11*a* or on its housing 11*a*.1.

Printing segments 11*a* are again provided adjacent to one another on the rotor 12, which in turn is mounted on the pillar 13 of the base unit 5*a* that corresponds to the base unit 5 so as to be rotatable and drivable about the vertical machine axis MA.

In the interior of its segmented housing 11*a*.1, each printing segment 11*a* has the functional segments needed for printing packages 2. These include, for example, at least one inkjet print head 35 having electronically controllable discharge jets for printing color or printing ink and other media. The print heads 35 are arranged in at least one row parallel to the printing-segment axis DA.

A drying device 36 for the immediate drying of the printing color or corresponding printed image applied to package 2 is associated with each print head 35. In the depicted embodiment, the drying device 36 is an infrared and/or UV emitter discharging a linear field of UV and/or infrared radiation 37 that covers at least the entire printed image applied with print head 35. The drying device 36 is offset by some angle against print head 35 relative to the printing-segment axis DA.

During printing of a package 2, the print head is subjected to a controlled rotation about the printing-segment axis DA in such a way that the printing color applied with the print head 35 is dried or at least largely dried with the UV and/or infrared radiation 37 immediately following application.

In a way not otherwise represented, drying device 36 is cooled, for example using air and/or water as the cooling medium.

The print head 35, the drying device 36, as well as electronics 38 configured at least as a driver stage for the print head 35, are all provided on a common carriage 39 that is adjustably guided in the direction of the printing-segment axis DA on a pillar 40 by way of a positioning drive 41. In the depicted embodiment, by way of a positioning or angular drive 42 that is provided on carriage 39, the print head 35 and the drying device 36 can again be adjusted by pivoting, preferably by pivoting about at least one axis that is square to the printing-segment axis DA and tangential to the periphery of transport-and-treatment element 7*b* as formed by the printing segments 11*a*. As a result, the position of the print head 35 can be matched to the position of the packaging element surface that is to be printed upon such that the jet openings of the print head 35 are as close as possible to the package's surface and so that the center-lines of the jet openings are as square as possible relative to the package surface that is to be printed upon.

To avoid fouling the printing segment 11*a* with sprayed ink, the print head 35 is configured with a protective element 35.1. The protective element 35.1 can be blade-like, scale-like and/or rubber-ball-like. During printing, the protective element 35.1 lies against the package 2 being printed upon to outwardly limit the printed space.

To configure the bundled linear infrared beam 37, the drying device 36 is executed with an optical beam forming element 36.1 in the form of a cylindrical lens and with a protective and guiding aperture 36.2.

Accommodated in the interior of housing 11*a*.1 are other functional elements of the printing segment 11. These include a pressure-balancing tank 43 for the colored-ink, pumps 44 for feeding ink and for removing surplus ink, as well as other functional elements that are not depicted, such as electronic control elements for the controlling of the respective printing segment 11 and the controlling of drives 41 and 42 etc. The underside of the housing 11*a*.1 is provided with a coupling unit 45 by which all necessary electrical connections (in particular also for drives and controlling and monitoring data) and all fluid connections (for cooling functional elements and for feeding ink) can be made by plugging into a matching coupling unit (coupling panel) provided on the rotor 12.

On the narrow rear side, which lies radially inward relative to machine axis MA, mechanical holding-and-centering elements 46 are provided on the housing 11*a*.1 of each printing segment 11*a*. With these holding-and-centering elements 46, a secure and exact connecting of the print module 11*a* with the rotor 12 or with a rotor element concentrically surrounding machine axis MA is at least partially possible by plugging in the printing segment 11*a*.

An aperture-like wall 49 is provided on the inside of the recess or mounting 15. The aperture-like wall 49 closes off the interior space of housing 11 except for openings for the carrier 17, the print head 35 and UV and/or infrared drying unit 36.

It has been assumed above that the holding-and-centering units 16 are part of individual modules 4.1-4.*n* or printing segments 11, 11*a*. In a preferred embodiment however, the holding-and-centering units 16 are pucks. Each puck picks up a package 2 at the package inlet 1.1 and only releases that package 2 again at the package outlet 1.2. This means that each package 2 is held constantly on one and the same holding-and-centering unit 16 on the transport path 3 between package inlet 1.1 and the package outlet 1.2.

Figure 17:
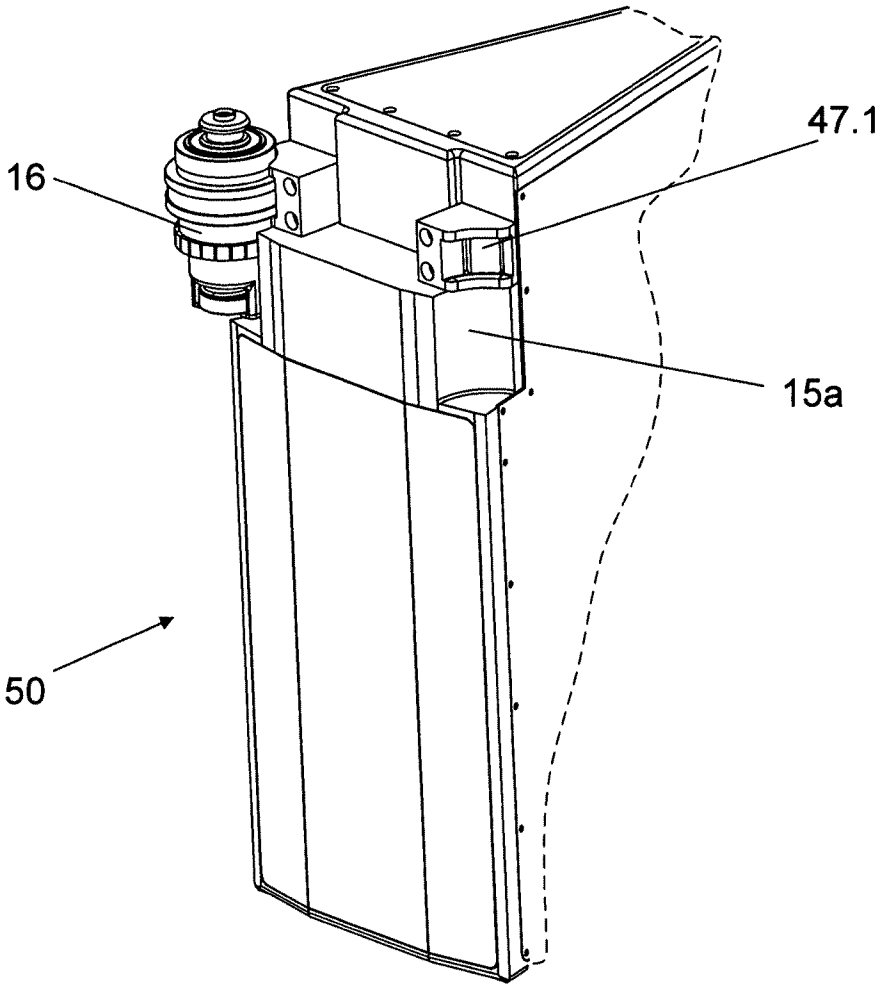
FIGS. 17 and 18 each show, in perspective partial view, a dummy segment for use with the device or installation of FIG. 1 or with the transport-and-treatment element of FIG. 12.

In the course of traversing the transport path 3, the holding-and-centering unit 16 is passed on from a transport-and-treatment element 7, 7*a*, 7*b* or from a mounting 15 located there to a transport-and-treatment element 7, 7*a*, 7*b* following in transport direction A or to a mounting 15 located there. Mechanisms for holding and releasing the holding-and-centering units 16 are provided on the carriers 17 of the printing segments 11 or on the printing segments 11*a* for this purpose. FIG. 17 shows one example in the form of a radially projecting holding ring that interacts with or is held by controlled solenoids 47. Other gripper-like mounting, holding and/or transfer elements can also be used.

From the package outlet 1.2, the holding-and-centering units 16 are returned on a puck transport path to the package inlet 1.1. This puck transport path, which is schematically and/or functionally suggested in FIG. 1 by the broken line 48, is constituted by autonomous transport-and-treatment elements or by transport-and-treatment elements 7. In the latter case, an additional mounting 15*a* is then provided between two recesses 15 for the mounting of a holding-and-centering unit 16 (FIGS. 4 and 12). In the case of the depicted embodiments, this is formed by corresponding concave vaults in the face of each of two printing segments, such as printing segments 11, 11*a* or their respective housings 11.1, 11*a*.1. These additional recesses 15*a* for the empty holding-and-centering units 16 that are to be returned are thus each formed from two part-recesses and are, in the depicted example, on the same level as the receptacles 15. Additional recesses 15*a* also exhibit holding magnets and solenoids 47.1, with a holding magnet and solenoid 47.1, also executed as a permanent magnet if necessary, being provided at least in every second, and ideally in both part-receptacles.

Figure 18:
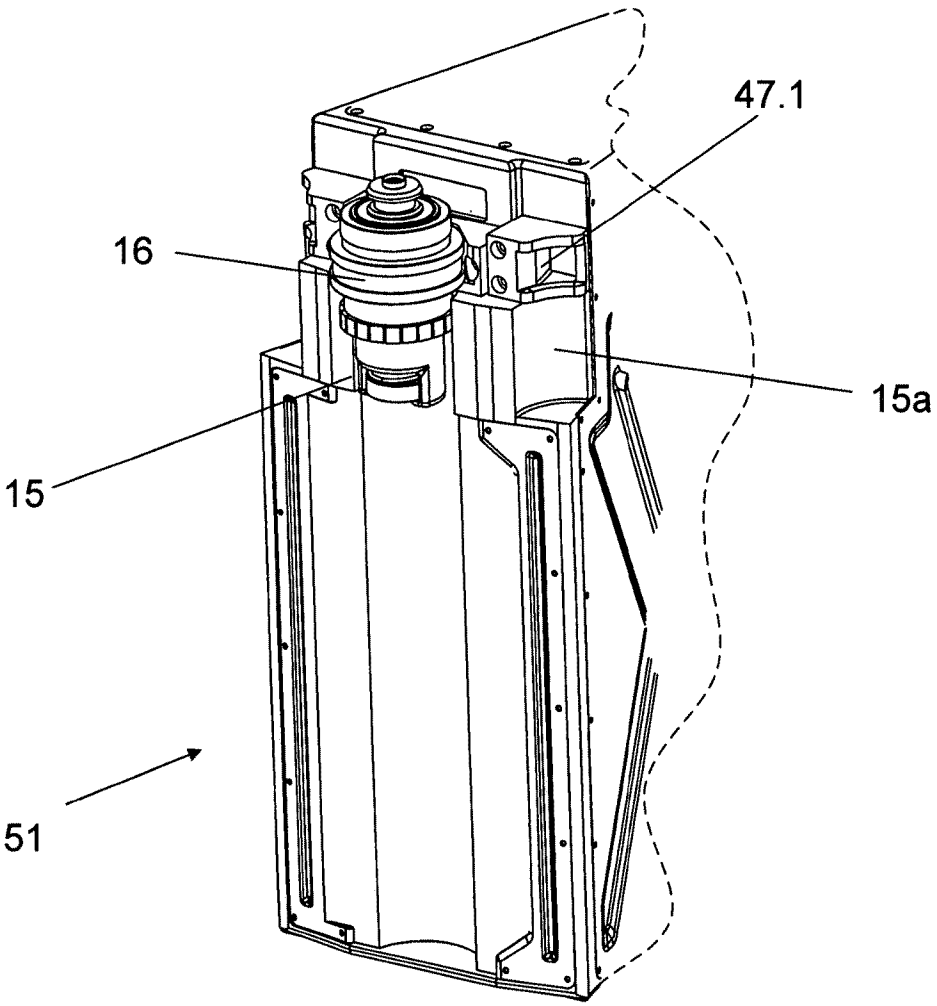

FIGS. 17 and 18 show two different dummy segments 50, 51 that match, or that have housings that match the shape, size, or dimension of the printing segments 11*a* and that essentially differs from the printing segments 11*a* only because they do not exhibit all of the functional elements needed for the printing of packages 2.

The dummy segments 50, 51 are arranged on transport-and-treatment elements 7*b* between printing segments 11*a* in order to reduce the number of handling positions 8 formed by printing segments 11*a* on transport-and-treatment elements 7*b* if, for example, only a reduced throughput (number of packages 2 handled per unit of time) is required for the corresponding device 1. The dummy segments 50, 51 can also be used to return holding-and-centering units 16, which are configured as pucks, from the package outlet 1.2 to the package inlet 1.1, with holding-and-centering units 16 being held either at the receptacles 15 or at regions of the dummy segments 50, 51 that correspond to receptacles 15*a*.

FIG. 12 shows an annular tank 42 surrounding the pillar 13. The annular tank 42 receives ink of the respective printing color. It is provided, for example, on the base unit 5*a* and is connected by a rotary connection with pressure balancing tanks 43 and/or with pumps 44 located at the pressure balancing tanks 43.

Among the advantages are that the relationship of packages 2 to the basic machine or device 1 is decoupled, i.e. in particular holding-and-centering units 16, which are configured as pucks, can be adapted to different shapes, sizes, etc. of packages 2 and that a height adjustment of carriers 17 and/or of carriages 39 carrying print heads 35 is also possible for adapting to the different shapes, sizes, and forms of packages 2.

Another advantage of the invention is that printing segments 11, 11*a* are configured as fully functional assembly units or modules. This means that not only is the assembly of the respective device 1 simplified, but it is also possible to replace, for example, faulty printing segments 11, 11*a* and to repair such printing segments 11, 11*a* outside the device 1.

Yet another advantage is simplification of stock-keeping by the manufacturer of the device 1.

Yet another advantage is that the use of dummy segments 50, 51 makes it possible to adapt device 1 to a reduced throughput.

Another advantage is that structurally identical base units 5 can be used with structurally identical printing segments 11 to realize the device 1. This generally results in a compact design for the device 1.

The invention has been described by reference to particular embodiments. However, numerous variations as well as modifications are possible, in particular including to holding-and-centering units 16, printing segments 11, 11*a* and the device as a whole, without departing from the inventive concept underlying the invention.

For example, instead of the code 23 being on the primary part 19, the code 23 can be provided on the secondary part 20, or on both to then together constitute, with an incremental sensor disposed on the printing segment 11, 11*a*, an encoder system for the aligning and/or controlled rotating of packages 2.

The invention has also been described in the context of packages 2 that are bottles. The inventive device, its holding-and-centering units, and its printing segments are however also suited to the applying a furnishing onto other containers or packages.

The invention claimed is:

1. An apparatus for treating packages by applying furnishing features to said packages, said apparatus comprising a plurality of holding-and-centering units, each of which comprises a primary part and a secondary part, wherein at least one of said primary part and said secondary part comprises a coding, wherein said primary part is held at a holding position during package handling, wherein said secondary part is mounted on or in said primary part so as to be rotatable about a vertical axis of said holding-and-centering unit, wherein said secondary part receives a functional element necessary for handling a package, wherein said secondary part is driven by a motor during handling of a package, wherein a plurality of secondary parts adapted to different types, forms and/or sizes of packages are associated with said primary parts, wherein package handling comprises at least one of holding, centering, aligning, moving, rotating, and pivoting a package at said holding positions, wherein said features comprise printed material having plural colors, wherein said apparatus further comprises a package inlet, a package outlet, a package-transport path on which packages are moved in a transport direction from said package inlet to said package outlet, and a sensor, wherein said coding indicates rotational angle position to said sensor, wherein said package-transport path comprises at least one transport-and-treatment element that can be driven to rotate about a vertical machine-axis, wherein said transport-and-treatment element comprises a plurality of holding positions, each of which comprises one of said holding-and-centering units for package handling.

2. The apparatus of claim 1, further comprising an electromagnetic direct drive for controlled handling of a package, wherein said electromagnetic direct drive comprises a rotor and a stationary structure, wherein said stationary structure is one of a stator and a solenoid array, wherein said rotor comprises an array of permanent magnets that interact with said stationary structure, and wherein controlled handling is selected from the group consisting of aligning a package and rotating a package.

3. The apparatus of claim 1, wherein said secondary part comprises a format-adapted interchangeable mounting-and-base part and an infinitely controllable electric motor, and wherein said primary part comprises a motor housing of said infinitely controllable motor.

4. The apparatus of claim 1, further comprising functional elements for aligning and/or controlled moving of a package during handling thereof, wherein said functional elements are provided on a respective secondary part.

5. The apparatus of claim 1, wherein said package-transport path comprises a plurality of transport-and-treatment elements adjacent to one another for transporting packages, wherein each of said transport-and-treatment elements can be driven to rotate said holding positions about said vertical machine-axis.

6. The apparatus of claim 1, wherein said secondary parts are each configured with a format-adapted interchangeable mounting-and-base part.

7. The apparatus of claim 1, wherein said holding-and-centering units comprise pucks, wherein at said package inlet, each puck picks up a package, and wherein each puck is moved with said picked-up package from said package inlet to said package outlet along said package-transport path, wherein upon arriving at said package outlet, each puck releases said picked-up package, and wherein said apparatus further comprises a puck-transport path over which pucks are returned from said package outlet back to said package inlet.

8. The apparatus of claim 7, wherein said puck-transport path is at least in part constituted by those transport-and-treatment elements that are also part of said package-transport path.

9. The apparatus of claim 7, further comprising receptacles formed between said holding positions to receive said pucks, wherein said receptacles are part of said puck-transport path.

10. The apparatus of claim 1, further comprising, at each holding position, a holder configured as a carrier for holding a holding-and-centering element, wherein said holder is height-adjustable in a direction along said machine axis.

11. The apparatus of claim 1, further comprising, at each holding position, a mechanism for controlled holding and releasing of holding-and-centering elements.

12. The apparatus of claim 1, wherein said secondary part comprises an RFID tag.

13. The apparatus of claim 1, wherein each holding position comprises an inkjet print head and a radiation source for at least one of curing and drying of ink, wherein said radiation source is selected from the group consisting of a thermal-radiation source, a microwave-radiation source, and a UV-radiation source.

14. The apparatus of claim 13, wherein said print head is adjustable in at least one of a direction along said machine axis and an inclination relative to said machine axis.

15. The apparatus of claim 1, wherein at least one transport-and-treatment element is connectable to a pressure medium, wherein said transport-and-treatment element comprises at least one coupling element, wherein each of said holding-and-centering units further comprises a quick-acting coupling for coupling to a source of pressure medium via said coupling element, and wherein said pressure medium is selected from the group consisting of a gaseous medium, a vaporous medium, and compressed air, whereby a package held at a holding-and-centering unit at said transport-and-treatment element is able to be pressurized with said pressure medium.

16. The apparatus of claim 15, wherein said quick-acting coupling is configured as a non-return valve such that after preloading a package with said pressure medium to a pressure, said pressure can be maintained in said package as said package traverses said package element transport section.

17. The apparatus of claim 1, wherein each secondary part includes a centering-and-holding element that is configured for passively holding a package with a spring force.

18. The apparatus of claim 1, wherein each holding-and-centering unit comprises a recess configured to cover said package in a region of a mouth thereof.

19. The apparatus of claim 1, wherein said holding-and-centering units are held at an associated printing segment by passive application of a holding force to primary parts thereof, and wherein said holding-and-centering units are actively removed from said printing segments.

20. The apparatus of claim 1, further comprising an electromagnetic direct drive for controlled handling of a package, wherein said electromagnetic direct drive comprises a rotor and a stationary structure, wherein said stationary structure is one of a stator and a solenoid array, and wherein said rotor comprises an array of permanent magnets that interact with said stationary structure.

21. The apparatus of claim 1, wherein each of said holding-and-centering units comprises a secondary part that comprises a format-adapted interchangeable mounting-and-base part and an infinitely controllable electric motor, and wherein said primary part comprises a motor housing of said infinitely controllable motor.

22. An apparatus for treating packages by applying furnishing features to said packages, said apparatus comprising a plurality of holding-and-centering units, each of which comprises a primary part and a secondary part, wherein at least one of said primary part and said secondary part of each of said holding-and-centering units comprises a coding, wherein said primary part is held at a holding position during package handling, wherein said secondary part is mounted on or in said primary part so as to be rotatable about a vertical axis of said holding-and-centering unit, wherein said secondary part receives a functional element necessary for handling a package, wherein said secondary part is driven by a motor during handling of a package, wherein a plurality of secondary parts adapted to different types, forms and/or sizes of packages are associated with said primary parts, wherein package handling comprises at least one of holding, centering, aligning, moving, rotating, and pivoting a package at said holding positions, wherein said features comprise printed material having plural colors, and an incremental sensor, wherein said coding indicates rotational angle position to said incremental sensor.

23. The apparatus of claim 22, further comprising an electromagnetic direct drive for controlled handling of a package, wherein said electromagnetic direct drive comprises a rotor and a stationary structure, wherein said stationary structure is one of a stator and a solenoid array, and wherein said rotor comprises an array of permanent magnets that interact with said stationary structure.

24. The apparatus of claim 22, wherein said secondary part comprises a format-adapted interchangeable mounting-and-base part and an infinitely controllable electric motor, and wherein said primary part comprises a motor housing of said infinitely controllable motor.

25. The apparatus of claim 22, further comprising functional elements for aligning and/or controlled moving of a package during handling thereof, wherein said functional elements are provided on a respective secondary part.

26. The apparatus of claim 22, further comprising a package inlet, a package outlet, and a package-transport path on which packages are moved in a transport direction from said package inlet to said package outlet, wherein said holding-and-centering units comprise pucks, wherein at said package inlet, each puck picks up a package, and wherein each puck is moved with said picked-up package from said package inlet to said package outlet along said package-transport path, wherein upon arriving at said package outlet, each puck releases said picked-up package, and wherein said apparatus further comprises a puck-transport path over which pucks are returned from said package outlet back to said package inlet.

27. An apparatus for treating packages by applying furnishing features to said packages, said apparatus comprising a plurality of holding-and-centering units, each of which comprises a primary part and a secondary part, wherein said primary part is held at a holding position during package handling, wherein said secondary part is mounted on or in said primary part so as to be rotatable about a vertical axis of said holding-and-centering unit, wherein said secondary part receives a functional element necessary for handling a package, wherein said secondary part is driven by a motor during handling of a package, wherein a plurality of secondary parts adapted to different types, forms and/or sizes of packages are associated with said primary parts, wherein package handling comprises at least one of holding, centering, aligning, moving, rotating, and pivoting a package at said holding positions, and wherein said features comprise printed material having plural colors, wherein each of said holding-and-centering units further comprises a coupling element, a mating piece for said coupling element for establishing a connection to a supply of a pressure medium, and a lower opening through which said pressure medium is guided into a package to load said package with a preload pressure, wherein said pressure medium is selected from the group consisting of vaporous medium, gaseous medium, and compressed air.

28. The apparatus of claim 27, wherein said mating piece comprises a non-return valve in said central inner line such that said preload pressure is maintained in said package while said package traverses said package transport section.

* * * * *